US006023226A

United States Patent [19]

Morin et al.

[11] Patent Number: 6,023,226

[45] **Date of Patent: *Feb. 8, 2000**

[54] EAS MARKER WITH FLUX CONCENTRATORS HAVING MAGNETIC ANISOTROPY ORIENTED TRANSVERSELY TO LENGTH OF ACTIVE ELEMENT

[75] Inventors: Sylvie R. Morin, Deerfield Beach; Wing K. Ho, Boynton Beach, both of Fla.; Kevin R. Coffey, Fremont, Calif.

[73] Assignee: Sensormatic Electronics Corporation, Boca Raton, Fla.

[ * ] Notice: This patent is subject to a terminal disclaimer.

[21] Appl. No.: 09/015,236

[22] Filed: Jan. 29, 1998

[51] Int. Cl.[7] ..... G08B 13/14

[52] U.S. Cl. ..... 340/572.1; 340/572.2; 340/572.6; 340/568.1; 340/551; 428/611; 428/900; 428/928; 148/108

[58] Field of Search ..... 340/572.1, 572.2, 340/572.6, 572.5, 568.1, 551; 428/611, 900, 928; 148/108

[56] References Cited

U.S. PATENT DOCUMENTS

| | | | |
|---|---|---|---|
| 3,790,945 | 2/1974 | Fearon | 340/280 |
| 4,075,618 | 2/1978 | Montean | 340/280 |
| 4,710,754 | 12/1987 | Montean | 340/572 |
| 4,797,658 | 1/1989 | Humphrey | 340/551 |
| 4,980,670 | 12/1990 | Humphrey et al. | 340/551 |
| 5,204,526 | 4/1993 | Yamashita et al. | 340/551 |
| 5,519,379 | 5/1996 | Ho et al. | 340/551 |
| 5,565,849 | 10/1996 | Ho et al. | 340/572 |
| 5,605,768 | 2/1997 | Furukawa et al. | 340/551 |
| 5,650,236 | 7/1997 | Hirano et al. | 428/611 |
| 5,777,553 | 7/1998 | Perreau et al. | 340/551 |
| 5,801,630 | 9/1998 | Ho et al. | 340/572 |
| 5,835,016 | 11/1998 | Ho et al. | 340/568 |

*Primary Examiner*—Nina Tong
*Attorney, Agent, or Firm*—Robin, Blecker & Daley

[57] ABSTRACT

A harmonic-type electronic article surveillance marker includes a thin, elongated active element and flux concentrators provided at the ends of the active element. The flux concentrators have magnetic anisotropies that are oriented perpendicular to the length of the active element. The orientation of the magnetic anisotropies and the anisotropy field of the flux concentrators stabilize the switching threshold of the marker. The switching threshold level can be controlled by varying parameters such as the angle of the magnetic anisotropies relative to the length of the active element, the strength of the anisotropy field of the magnetic anisotropies, and the geometry of the active element and the flux concentrators.

19 Claims, 4 Drawing Sheets

EAS MARKER WITH FLUX CONCENTRATORS HAVING MAGNETIC ANISOTROPY ORIENTED TRANSVERSELY TO LENGTH OF ACTIVE ELEMENT

FIELD OF INVENTION

This invention relates to article surveillance and more particularly to article surveillance systems generally referred to as of the harmonic type.

BACKGROUND OF THE INVENTION

It is well known to provide electronic article surveillance (EAS) systems to prevent or deter theft of merchandise from retail establishments. In a typical system, markers designed to interact with a magnetic field placed at the store exit are secured to articles of merchandise. If a marker is brought into the field or "surveillance zone," the presence of the marker is detected and an alarm is generated.

One type of magnetic EAS system is referred to as a harmonic system because it is based on the principle that a magnetic material passing through an electromagnetic field having a selected frequency disturbs the field and produces harmonic perturbations of the selected frequency. The detection system is tuned to recognize certain harmonic frequencies and, if present, causes an alarm.

A basic problem in the design of markers for harmonic EAS systems is the need to have the marker generate a harmonic signal that is both of sufficient amplitude to be readily detectable and also is sufficiently unique so that the detection equipment can be tuned to detect only the signal generated by the marker, while disregarding harmonic disturbances caused by the presence of items such as coins, keys, and so forth. A known approach to this problem is to develop markers that produce high order harmonics with sufficient amplitude to be readily detectable. A particularly useful technique along these lines is disclosed in U.S. Pat. No. 4,660,025, issued to Humphrey, the disclosure of which is incorporated herein by reference. The Humphrey patent discloses a harmonic EAS marker employing as its active element a wire or strip of 5 magnetic material which has a magnetic hysteresis loop with a large discontinuity, known as a "Barkhausen discontinuity". Upon exposure to an alternating-magnetic field of sufficient amplitude, the active element undergoes substantially instantaneous regenerative reversals in magnetic polarity, producing very sharp signal spikes that are rich in detectable high harmonics of the frequency of the alternating field.

Markers employing the type of active element just described have been successfully placed in practice and are in widespread use with harmonic EAS systems distributed by the assignee of the present application under the trademark "AISLEKEEPER".

It has been desired to reduce the size, and particularly the length of harmonic markers which employ active elements of the type disclosed in the Humphrey patent. One constraint upon reducing the length of the active element is that large Barkhausen discontinuities can only be produced in active elements having a high ratio of length to cross-sectional area to provide a very low demagnetizing factor. It could be contemplated to reduce both the length and cross section of active elements, or to form the active elements as thin films, but the resulting elements are very low in mass, and produce signals that are too low in amplitude for reliable detection.

U.S. Pat. No. 5,519,379, which has a common assignee and a common inventor with the present application, discloses a harmonic marker which includes three lengths of wire, arranged in parallel with each other. The three wires have the above-described hysteresis loop with a large Barkhausen discontinuity. Charge spreading elements are provided at the ends of the three wires to magnetically couple the wires so that all three wires switch magnetic polarity substantially simultaneously upon exposure to the alternating magnetic field used to detect the marker. The charge spreading elements (which can also be considered flux concentrating elements) each have a magnetic anisotropy that is oriented in substantially the same direction as the three wires. The simultaneous switching of the three wires provides a signal that is comparable in amplitude and sharpness to that provided by a single, longer wire.

U.S. Pat. Nos. 4,075,618 and 4,710,754 disclose harmonic markers in which a relatively wide flux concentrating element is provided integrally at each end of a relatively narrow "switching" section which constitutes the active element of the harmonic marker.

In addition to high signal amplitude and reduced length, it is another desirable characteristic of a harmonic marker that its hysteresis loop characteristic be "stable". That is, it is desirable that the threshold level, which is the applied field level at which the Barkhausen discontinuity occurs, be substantially unchanged from cycle to cycle of the alternating interrogation field. When a marker exhibits an unstable hysteresis loop characteristic, it may be difficult to reliably detect the marker.

OBJECTS AND SUMMARY OF THE INVENTION

It is a primary object of the invention to provide a harmonic EAS marker that is relatively short, and provides an output signal that has substantial amplitude. It is a further object to provide such a marker that has a stable hysteresis loop characteristic.

It is an additional object to provide a harmonic EAS marker exhibiting a Barkhausen jump with a switching threshold field level that can be controlled by varying parameters of the marker.

According to the invention, there is provided a marker for use in an article surveillance system in which an alternating magnetic field is established in a surveillance region and an alarm is activated when a predetermined perturbation to the field is detected, with the marker including an elongate body of magnetic material having a longitudinal axis, a first flux concentrator in contact with a first end of the elongate body, a second flux concentrator in contact with a second end of the elongate body, and means for securing the elongate body and the flux concentrators to an article to be maintained under surveillance; wherein the first and second flux concentrators have respective magnetic anisotropies which have respective orientations that are substantially angled relative to the longitudinal axis of the elongate body, and the marker has a magnetic hysteresis loop with a large Barkhausen discontinuity such that exposure of the marker to an external-magnetic field, whose field strength in the direction opposing the magnetic polarization of the body exceeds a predetermined threshold value, results in regenerative reversal of the magnetic polarity.

The magnetic anisotropies of the flux concentrators may, for example, be oriented substantially perpendicular to the longitudinal axis of the elongate body.

A marker provided in accordance with the invention is relatively short, generates a signal having a reasonably large amplitude and has a relatively stable hysteresis loop characteristic because of the presence of the flux concentrators which have magnetic anisotropies oriented at an angle from the length direction of the active element.

BRIEF DESCRIPTION OF THE DRAWINGS

The same reference numerals are used throughout the drawings to designate the same or similar parts.

DESCRIPTION OF THE PREFERRED EMBODIMENTS

Figure 1:
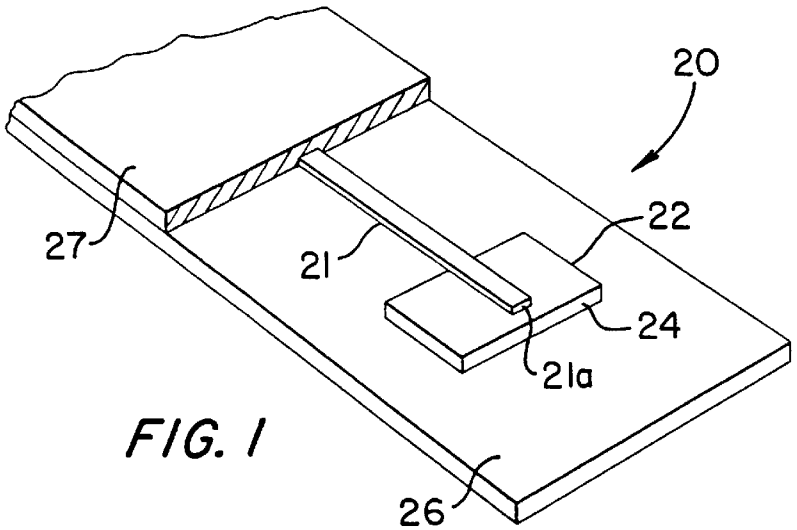
FIG. 1 is a perspective view with portions broken away of a harmonic EAS marker in accordance with the present invention.

Referring to FIG. 1, a marker in accordance with a first embodiment of the present invention is generally indicated by reference numeral 20. The marker 20 includes a ribbon-shaped strip 21 of amorphous metal alloy which constitutes the active element of the marker. An end 21*a* of the active element 21 rests on a generally planar and rectangular flux concentrator 22. The end 21*a* of the active element 21 is close to an outer edge 24 of the flux concentrator 22. As seen from FIG. 2, which is a schematic plan representation of the marker 20, the marker also includes a second flux concentrator 23 which has resting thereon an opposite end 21b of the active element 21. The end 21*b* of the active element is near an outer edge 25 of the flux concentrator 23.

The active element 21 and the flux concentrators 22 and 23 are sandwiched between a substrate 26 and a overlayer 27, which may be like conventional elements of a harmonic EAS marker. An adhesive may be provided on the lower surface of the substrate 26 for use in affixing the marker 20 to an article of merchandise (not shown).

The flux concentrators 22 and 23 are preferably formed of a soft amorphous magnetic material. A material designated as Metglas 2705MN, available from AlliedSignal Specialty Metals, Parsippany, N.J., and having the composition $Co_{76}Fe_2B_{12}Si_6Mn_4$ (atomic percent) has been found to be suitable. The flux concentrators may be formed by cutting a ribbon or sheet of this material, but before cutting the material is annealed in the presence of a saturating magnetic field applied in the plane of the material to develop a magnetic anisotropy in the material. In accordance with the invention, the flux concentrator elements 22 and 23 which result from cutting the field-annealed sheet material are arranged in the marker 20 so that the magnetic anisotropies (easy axes) of the flux concentrators are arranged in a direction (indicated by arrow A in FIG. 2) which is substantially perpendicular to the orientation (indicated by arrow L) of the longitudinal axis of the active element 21. According to a preferred embodiment of the invention, the flux concentrators 22 and 23 are substantially identical to each other in shape and size, and have dimensions 10 mm by 11 mm by 0.024 mm, with the longer sides of the flux concentrators oriented perpendicular to the length of the active element 21. The active element 21 may be formed of a material designated as "VCB", which is available from Vacuumschmelze GMBH, Hanau, Germany. The VCB material essentially has the composition $Co_{74.5}Fe_{1.5}Mn_4Si_{11}B_9$ (atomic percent). In the above-mentioned preferred embodiment, the active element 21 has dimensions 26 mm by 2 mm by 0.025 mm. When driven with an alternating field having a peak amplitude of 1.5 Oe, the preferred embodiment of the marker 20 exhibits a hysteresis loop characteristic as illustrated in FIG. 3. To be noted at 28 and 30 in FIG. 3 are substantially vertical traces indicative of Barkhausen discontinuities. The hysteresis loop shown in FIG. 3 is a multicycle trace taken over many cycles of the excitation signal. The width of the vertical segments 28 and 30 shows the range of the switching thresholds of the material.

Figure 2:
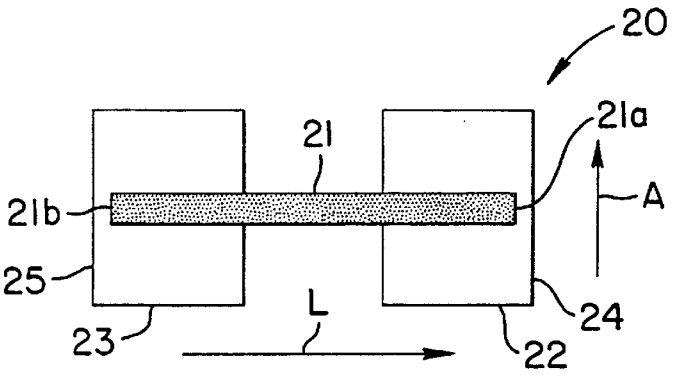
FIG. 2 is a schematic plan view of the marker of FIG. 1.
Figure 4:
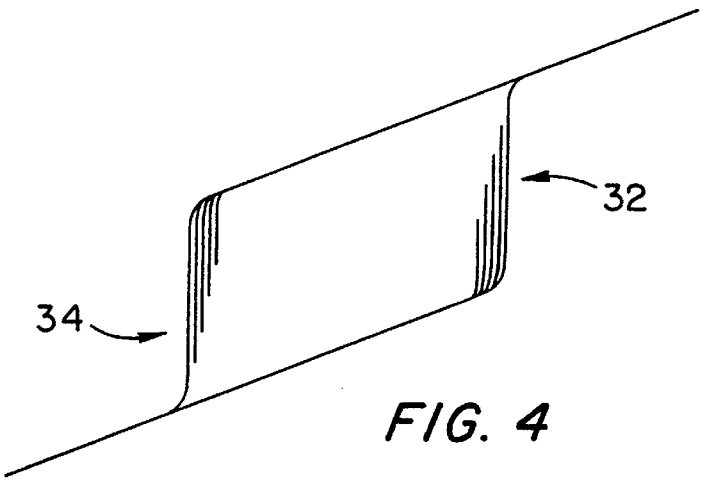
FIG. 4 shows a hysteresis loop characteristic of a marker formed with flux concentrators having magnetic anisotropies oriented in the same direction as the active element of the marker.
Figure 3:
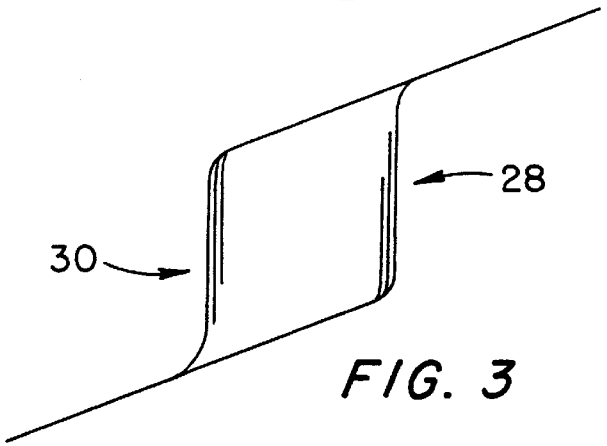
FIG. 3 shows a hysteresis loop characteristic of the marker of FIGS. 1 and 2.

For purposes of comparison, a marker like that shown in FIG. 2 was constructed, but with the flux concentrators arranged so that the magnetic anisotropies thereof were oriented in the same direction as the longitudinal axis of the active element 21. The hysteresis loop characteristic of the marker with flux concentrators having longitudinally-oriented anisotropies is shown in FIG. 4. As seen at 32 and 34 in FIG. 4, the vertical traces are quite wide, indicating considerable variation or instability in the switching threshold level from one drive cycle to another. The width of the traces 28 and 30 in FIG. 3 is much less, indicating greater stability in switching threshold as a result of the transverse orientation of the anisotropies of the flux concentrators in marker 20 of FIG. 2.

It is believed that some reduction in the instability of the hysteresis loop characteristic can be obtained when the anisotropies of the flux concentrators are oriented in directions between the longitudinal direction parallel to the length of the active element 21 and the perpendicular direction indicating the arrow A in FIG. 2, so long as there is a substantial angle between the orientation of the anisotropies and the longitudinal direction of the active element. In the preferred embodiment shown in FIG. 2 the respective orientations of the anisotropies of the flux concentrators are both perpendicular to the length of the active element 21 and therefore are parallel to each other. However, the respective orientations of the anisotropies of the flux concentrators may diverge from parallel relative to each other, whether or not one of the anisotropies is oriented perpendicular to the length of the active element.

Figure 5:
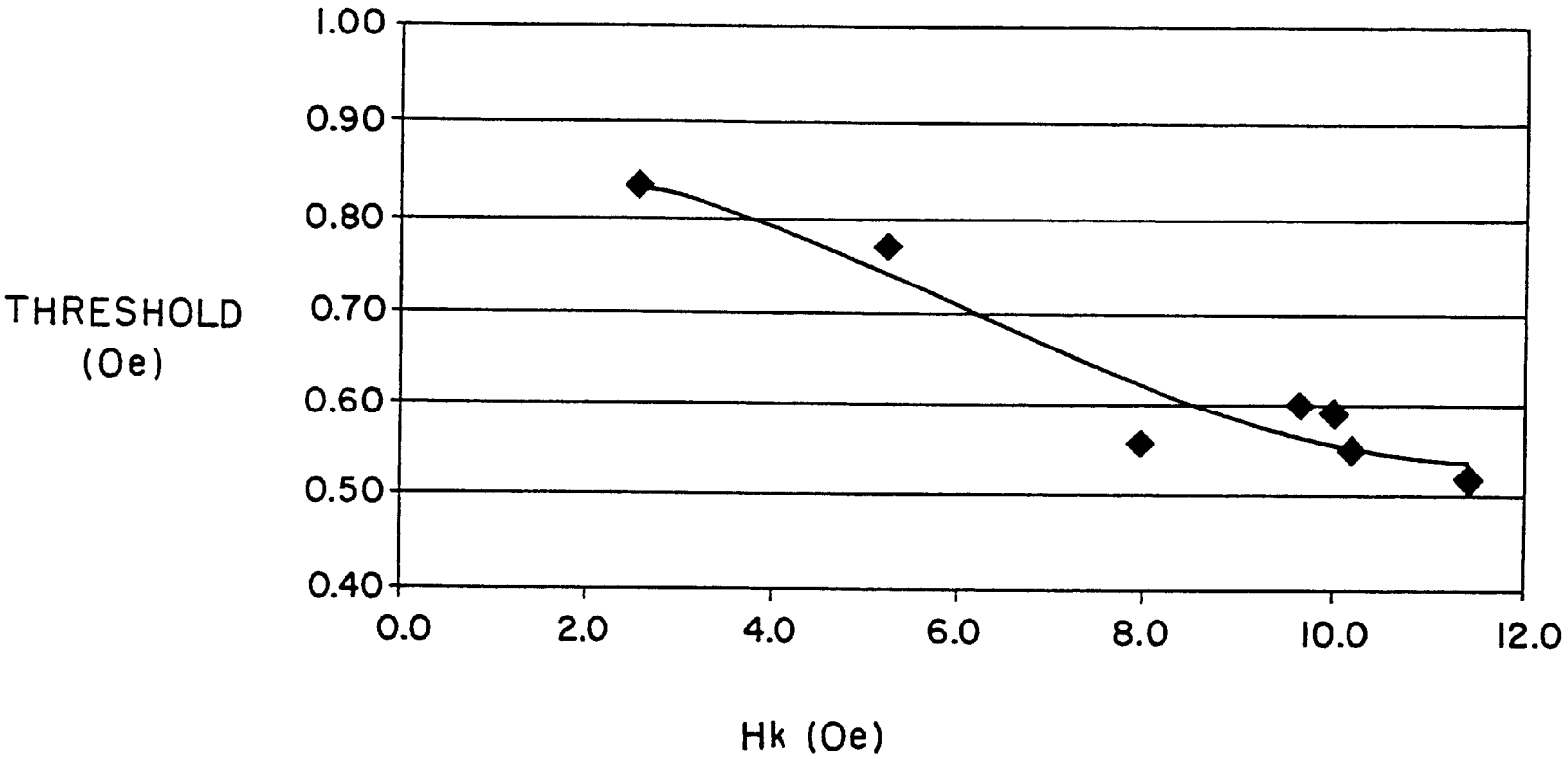
FIG. 5 illustrates how the switching threshold level of a marker produced in accordance with the invention varies according to the anisotropy field characteristic of flux concentrators utilized in the marker.

It has been found that the perpendicular anisotropy illustrated in FIG. 2 results in an increased stability in the hysteresis loop characteristic even with variations in the dimensions of the flux concentrators and the active element. It has also been found that variations in the anisotropy field of the anisotropies of the flux concentrators 22 and 23 causes variations in the switching threshold level. In another example of the embodiment of FIG. 2, an active element formed of the same VCB material mentioned above, but having a length of 28 mm was assembled with flux concentrators having dimensions 15 mm by 10 mm. As before, the longer sides of the flux concentrators were oriented perpendicular to the length of the active element. The flux concentrators used in this example were subjected to a variety of different field annealing procedures, to produce a range of anisotropy field levels. FIG. 5 graphically illustrates how the switching threshold level exhibited by the marker is influenced by the level of the transversely oriented anisotropy field (Hk) of the flux concentrators. In general, as shown in FIG. 5, larger anisotropy fields resulted in lower switching thresholds but the reduction in threshold is minimal when Hk is increased above some level, such as 10 Oe in this case. It is desirable that the switching threshold be made as low as possible as long as adequate output amplitude is also provided.

It was also found that varying the width of the flux concentrators (i.e., the extent of the flux concentrators in the direction transverse to the length to the active element) has an effect on the signal characteristics of the marker. Wider flux concentrators were found to produce higher switching threshold levels and higher amplitude output signals. This effect is reduced when a narrower active element (1 mm wide) is employed.

Using flux concentrators that were "longer" (i.e., with a greater extent in the direction parallel to the length of the active element) was found to result in lower switching thresholds, as well as more stable hysteresis characteristics.

Figure 6:
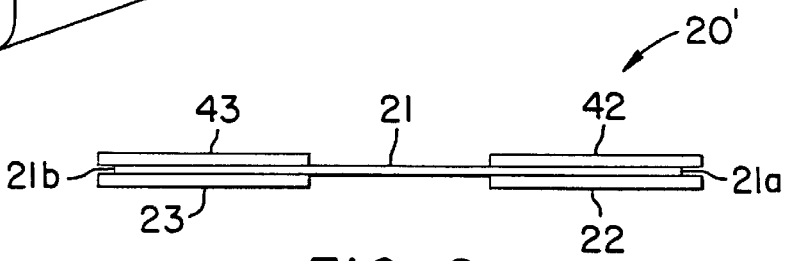
FIG. 6 is a schematic side view of a marker according to a second embodiment of the invention.

Another technique for promoting further stability of the hysteresis loop characteristic is illustrated in FIG. 6, which shows a marker 20' formed in accordance with a second embodiment of the invention. According to the embodiment of FIG. 6, each end 21*a*, 21*b* of the active element 21 is sandwiched between a pair of flux concentrators, all of which have magnetic anisotropies in the perpendicular direction illustrated in FIG. 2.

More specifically, and continuing to refer to FIG. 6, a flux concentrator 42 is provided at the end 21*a* of the active element 21 and at an opposite side of the active element 21 relative to the flux concentrator 22. In addition, a flux concentrator 43 is provided at the end 21*b* of the active element 21 at an opposite side of the active element 21 relative to the flux concentrator 23.

Figure 7:
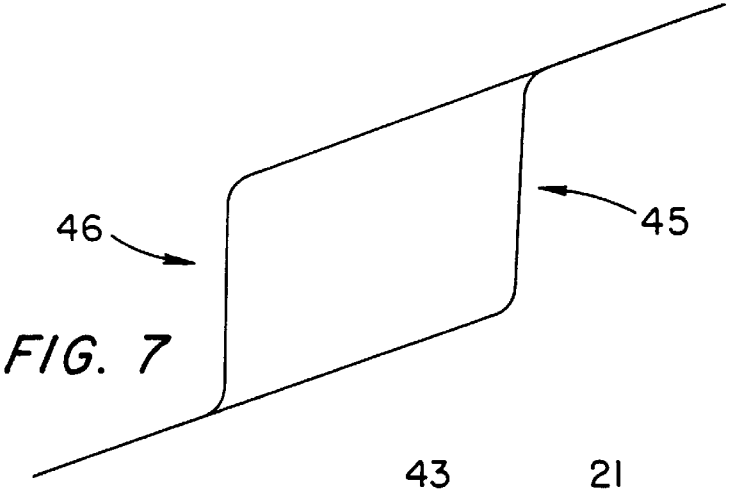
FIG. 7 is a hysteresis characteristic of the marker of FIG. 6.

FIG. 7 shows the hysteresis loop of the marker provided in accordance with the embodiments of FIG. 6. Comparing FIG. 7 with FIG. 3, it will be observed that the vertical traces 45 and 46 in FIG. 7 are still narrower than the corresponding traces 28 and 30 in FIG. 3, indicating a greater degree of stability in the hysteresis loop of FIG. 7.

Figure 8:
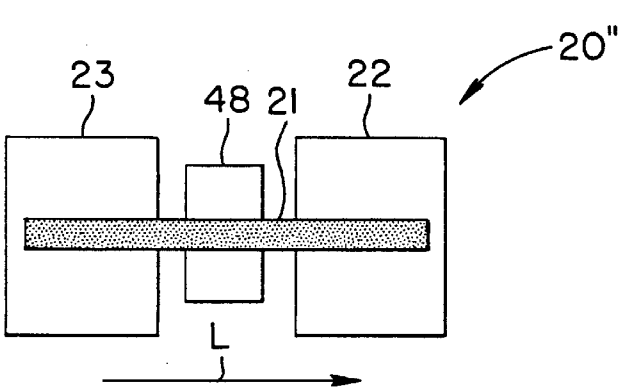
FIG. 8 is a schematic plan view of a marker according to a third embodiment of the invention.

Another technique which results in improved stability of the hysteresis loop characteristic is illustrated in FIG. 8, which schematically shows a marker 20" provided according to a third embodiment of the invention. The embodiment of FIG. 8 is formed by modifying the embodiment of FIG. 2 so as to add a third flux concentrator 48 positioned in contact with a central portion of the active element 21 and between (and not touching) the flux concentrators 22 and 23 positioned at the ends of the active element 21. Unlike the flux concentrators 22 and 23, the centrally-positioned flux concentrator 48 has a magnetic anisotropy that is oriented parallel to the length of the active element 21 (as indicated by the arrow L). In addition to improving switching threshold stability, the third flux concentrator 48 also tends to reduce the switching threshold level.

Figure 9:
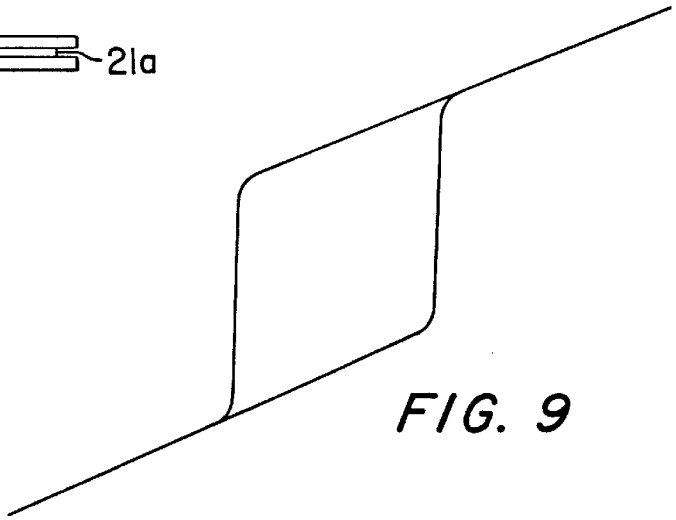
FIG. 9 is a hysteresis characteristic of the marker of FIG. 8.

FIG. 9 illustrates the hysteresis loop characteristic of the marker 21" of FIG. 8. It will be observed that the characteristic shown in FIG. 9 exhibits somewhat improved stability relative to the characteristic shown in FIG. 3.

Figure 10:
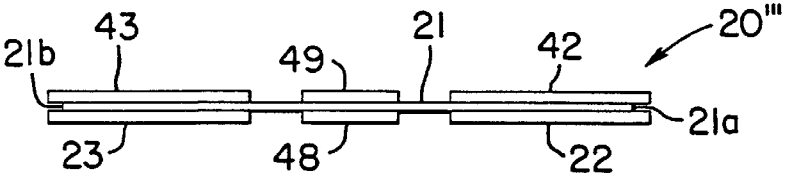
FIG. 10 is a schematic side view of a marker according to a fourth embodiment of the invention.

A fourth embodiment of the invention is schematically shown as marker 20'" in FIG. 10. The embodiment of FIG. 10 may be thought of as a combination of the embodiments of FIGS. 6 and 8, in that the marker shown in FIG. 10 is sandwiched between three pairs of flux concentrators, located respectively at the ends and the middle of the active element. Specifically, a first end 21*a* of the active element 21 is positioned between flux concentrators 22 and 42, both of which have magnetic anisotropies transversely oriented relative to the length of the active element 21. The other end 21*b* of the active element 21 is positioned between flux concentrators 23 and 43, which both have transverse magnetic anisotropies like the flux concentrators 22 and 42. Finally, at a central position between the ends of the active element 21, flux concentrators 48 and 49 are provided at opposite sides of the active element 21. Like the flux concentrator 48 shown in FIG. 8, the flux concentrators 48 and 49 of FIG. 10 have magnetic anisotropies oriented in the same direction as the length of the active element 21.

Figure 11:
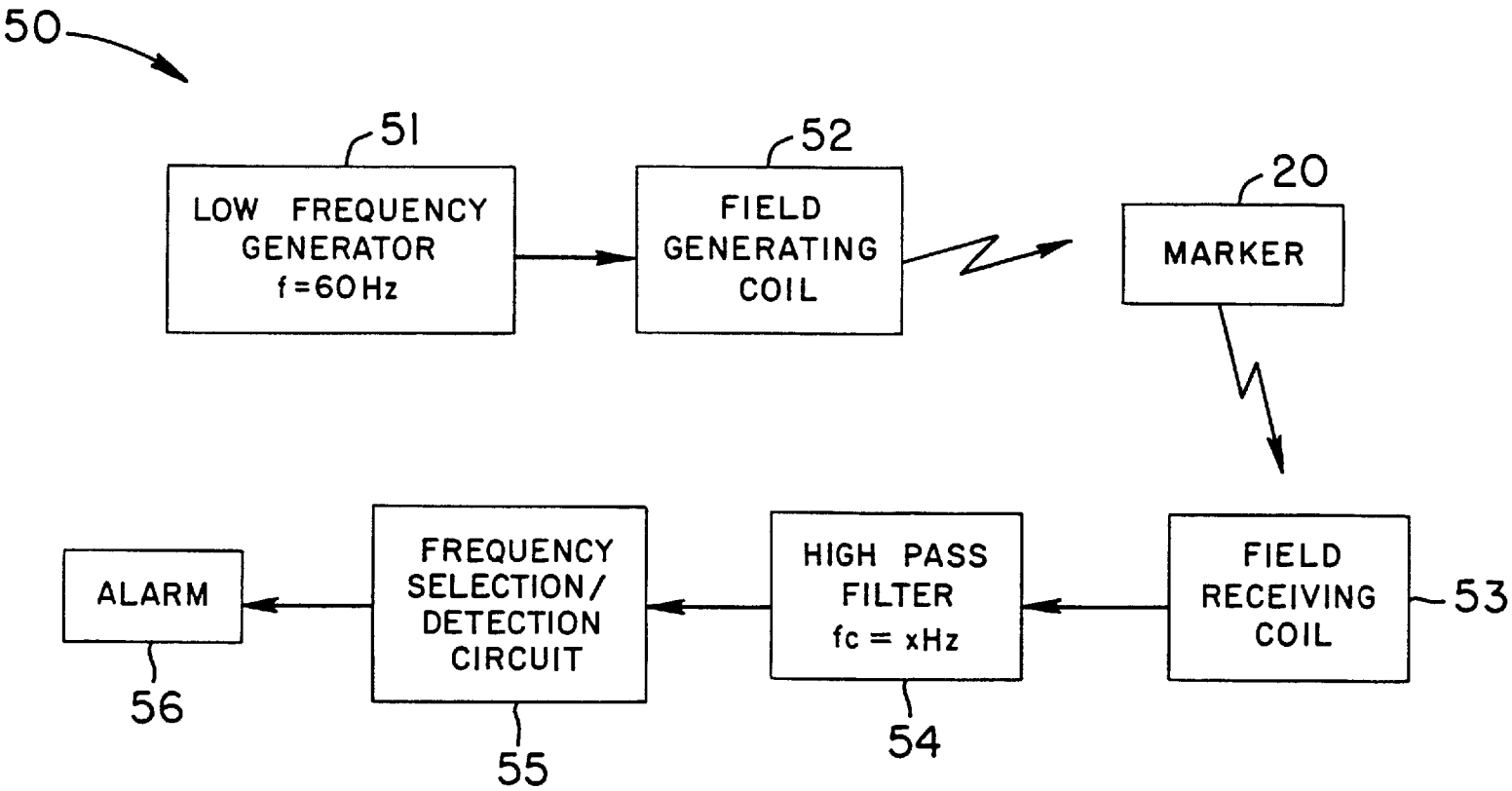
FIG. 11 is a block diagram of a typical system for generating a surveillance field and detecting the markers of the present invention.

A harmonic EAS system with which the markers of the present invention may be used is illustrated in block diagram form in FIG. 11. This system, generally indicated by reference numeral 50, includes a low-frequency generator 51 which generates a signal with a frequency around 60 Hz to drive a field generating coil 52. When a marker 20 is present in the field generated by the coil 52, perturbations caused by the marker 20 are received at field receiving coil 53. A signal output from the field receiving coil 53 passes through a high pass filter 54 which has a suitable cut-off frequency. The signal which passes through the filter 54 is supplied to a frequency selection/detection circuit 55, which can be set to detect a signal having a predetermined pattern of frequency, amplitude and/or pulse duration. Upon detection of the predetermined signal pattern, the circuit 55 furnishes an output signal to activate an alarm 56. Except for the marker 20, all of the elements shown in FIG. 11 may be like those presently used in the aforementioned "AISLEKEEPER" harmonic EAS system.

If it is desired that the markers disclosed herein be deactivatable, then a control element(s) (not shown) of a conventional type, such as a semi-hard magnet formed of Arnokrome 3 or Crovac, for instance, may be included in the markers. Deactivation of the markers can then be performed by magnetizing the control element to provide a bias field which changes the response of the active element to the surveillance field. It is also contemplated to deactivate the markers by relieving stress in the active element or crystallizing the active element in the case where the active element is formed of an amorphous material.

In the harmonic EAS markers disclosed herein, the performance and stability of the markers are enhanced by providing flux concentrators at the ends of the elongate active element, where the flux concentrators have magnetic anisotropies oriented at a substantial angle relative to the length of the active element. Characteristics of the markers such as signal amplitude and switching threshold level can be controlled by variations in one or more of the following: (a) orientation of the magnetic anisotropies of the flux concentrators relative to the length of the active element; (b) geometry of the flux concentrators and the active element; and (c) anisotropy field level of the flux concentrators.

Having described the present invention with reference to the presently preferred embodiments thereof, it should be understood that various changes can be made without departing from the true spirit of the invention as defined in the appended claims.

What is claimed is:

1. A marker for use in an article surveillance system in which an alternating magnetic field is established in a surveillance region and an alarm is activated when a predetermined perturbation to said field is detected, said marker comprising:

an elongate body of magnetic material, said body having a longitudinal axis;

a first flux concentrator in contact with a first end of said elongate body;

a second flux concentrator in contact with a second end of said elongate body; and means for securing said elongate body and said flux concentrators to an article to be maintained under surveillance;

said first and second flux concentrators having respective magnetic anisotropies, said anisotropies of said flux concentrators having respective orientations that are substantially angled relative to said longitudinal axis of said elongate body;

said marker having a magnetic hysteresis loop with a large Barkhausen discontinuity such that exposure of said marker to an external magnetic field, whose field strength in the direction opposing the magnetic polarization of said body exceeds a predetermined threshold value, results in regenerative reversal of said magnetic polarization.

2. A marker according to claim 1, wherein said anisotropies of said flux concentrators are substantially perpendicular to said longitudinal axis of said elongate body.

3. A marker according to claim 1, further comprising:

a third flux concentrator in contact with said first end of said elongate body at an opposite side of said elongate body relative to said first flux concentrator; and a fourth flux concentrator in contact with said second end of said elongate body at an opposite side of said elongate body relative to said second flux concentrator;

said third and fourth flux concentrators having respective magnetic anisotropies, said anisotropies of said third and fourth flux concentrators having respective orientations that are substantially angled relative to said longitudinal axis of said elongate body.

4. A marker according to claim 1, further comprising a third flux concentrator in contact with said elongate body at a position between said ends of said elongate body, said third flux concentrator having a magnetic anisotropy oriented parallel to said longitudinal axis of said elongate body.

5. A marker according to claim 4, further comprising:

a fourth flux concentrator in contact with said first end of said elongate body at an opposite side of said elongate body relative to said first flux concentrator;

a fifth flux concentrator in contact with said second end of said elongate body at an opposite side of said elongate body relative to said second flux concentrator; and a sixth flux concentrator in contact with said elongate body at a position between said ends of said elongate body at an opposite side of said elongate body relative to said third flux concentrator;

said fourth and fifth flux concentrators having respective magnetic anisotropies, said anisotropies of said fourth and fifth flux concentrators having respective orientations that are substantially angled relative to said longitudinal axis of said longitudinal body;

said sixth flux concentrator having a magnetic anisotropy oriented parallel to said longitudinal axis of said elongate body.

6. A marker according to claim 1, wherein said elongate body has a length extent of less than 37 mm.

7. A marker according to claim 1, wherein said elongate body is a discrete length of amorphous alloy ribbon.

8. A marker according to claim 1, wherein said predetermined threshold level is less than 1 Oe.

9. An article surveillance system comprising:

(a) generating means for generating an alternating magnetic field in a surveillance region;

(b) a marker secured to an article appointed for passage through said surveillance region, said marker including an elongate body of magnetic material, said body having a longitudinal axis, a first flux concentrator in contact with a first end of said elongate body, and a second flux concentrator in contact with a second end of said elongate body, said first and second flux concentrators having respective magnetic anisotropies, said anisotropies of said flux concentrators having respective orientations that are substantially angled relative to said longitudinal axis of said elongate body, said marker having a magnetic hysteresis loop with a large Barkhausen discontinuity such that exposure of said marker to an external magnetic field, whose field strength in the direction opposing the magnetic polarization of said body exceeds a predetermined threshold value, results in regenerative reversal of said magnetic polarization; and (c) detecting means for detecting a perturbation to said alternating magnetic field in said surveillance region resulting from the presence of said marker in said surveillance region.

10. An article surveillance system according to claim 9, wherein said anisotropies of said flux concentrators are substantially perpendicular to said longitudinal axis of said elongate body.

11. An article surveillance system according to claim 9, wherein said marker further includes a third flux concentrator in contact with said first end of said elongate body at an opposite side of said elongate body relative to said first flux concentrator and a fourth flux concentrator in contact with said second end of said elongate body at an opposite side of said elongate body relative to said second flux concentrator, said third and fourth flux concentrators having respective magnetic anisotropies, said anisotropies of said third and fourth flux concentrators having respective orientations that are substantially angled relative to said longitudinal axis of said elongate body.

12. An article surveillance system according to claim 9, wherein said marker further includes a third flux concentrator in contact with said elongate body at a position between said ends of said elongate body, said third flux concentrator having a magnetic anisotropy oriented parallel to said longitudinal axis of said elongate body.

13. An article surveillance system according to claim 9, wherein said predetermined threshold level is less than 1 Oe.

14. A method of making a marker for use in an article surveillance system in which an alternating magnetic field is established in a surveillance region and an alarm is activated when a predetermined perturbation to said field is detected, the method comprising the steps of:

providing an elongate body of magnetic material, said body having a longitudinal axis;

providing a first flux concentrator and a second flux concentrator, said first and second flux concentrators having respective magnetic anisotropies; and mounting each of said first and second flux concentrators at a respective end of said elongate body with the respective magnetic anisotropies of said flux concentrators oriented at a substantial angle relative to said longitudinal axis of said elongate body.

15. A method according to claim 14, further comprising the step of mounting a third flux concentrator on said elongate body at a position between said ends of said elongate body.

16. A method according to claim 14, further comprising the steps of:

mounting a third flux concentrator at an end of said elongate body with said end of said elongate body between said first flux concentrator and said third flux concentrator; and mounting a fourth flux concentrator at an end of said elongate body with said end of said elongate body between said second flux concentrator and said fourth flux concentrator.

17. A method according to claim 14, wherein said step of providing said flux concentrator comprises annealing a soft amorphous magnetic material in the presence of a magnetic field to form said magnetic anisotropies.

18. A method according to claim 14, wherein, after said mounting step, said predetermined threshold level is less than 1 Oe.

19. A method according to claim 14, when said mounting step is performed so that the respective magnetic anisotropies of said flux concentrators are oriented substantially perpendicular to said longitudinal axis of said elongate body.

* * * * *

UNITED STATES PATENT AND TRADEMARK OFFICE

CERTIFICATE OF CORRECTION

PATENT NO. : 6,023,226

DATED : February 8, 2000

INVENTOR(S) : Sylvie R. Morin

It is certified that error appears in the above-identified patent and that said Letters Patent are hereby corrected as shown below:

Col. 1, line 41, after "of" delete -- 5 --.

Signed and Sealed this

Third Day of April, 2001

*Attest:*

Nicholas P. Godici

NICHOLAS P. GODICI

*Attesting Officer*

*Acting Director of the United States Patent and Trademark Office*